US007963661B2

(12) United States Patent
Meeks

(10) Patent No.: US 7,963,661 B2
(45) Date of Patent: Jun. 21, 2011

(54) DISPLAY LIGHT FIXTURES

(75) Inventor: Michael Meeks, Forest City, NC (US)

(73) Assignee: American Greetings Corporation, Cleveland, OH (US)

( * ) Notice: Subject to any disclaimer, the term of this patent is extended or adjusted under 35 U.S.C. 154(b) by 359 days.

(21) Appl. No.: 12/367,786

(22) Filed: Feb. 9, 2009

(65) Prior Publication Data

US 2010/0202138 A1 Aug. 12, 2010

(51) Int. Cl.
*F21V 21/00* (2006.01)
*H01R 27/00* (2006.01)

(52) U.S. Cl. ..... 362/217.13; 362/217.12; 362/217.14; 362/217.16; 439/220; 439/226; 439/699.2

(58) Field of Classification Search ..... 362/217.01, 362/217.12, 217.13, 217.14, 217.16, 225, 362/430, 431, 432; 439/220, 226, 699.2
See application file for complete search history.

(56) References Cited

U.S. PATENT DOCUMENTS

| | | | | |
|---|---|---|---|---|
| 4,994,943 | A * | 2/1991 | Aspenwall | 362/219 |
| 5,904,415 | A | 5/1999 | Robertson et al. | |
| 6,641,419 | B1 | 11/2003 | Richardson | |
| 6,746,260 | B2 | 6/2004 | Chudkosky et al. | |
| 6,890,199 | B2 | 5/2005 | Vogt et al. | |
| 6,946,782 | B1 | 9/2005 | Beying et al. | |
| 7,291,029 | B2 | 11/2007 | Hale et al. | |
| 2004/0023539 | A1 | 2/2004 | Chudkosky et al. | |
| 2005/0202704 | A1 | 9/2005 | Lingemann et al. | |
| 2005/0277321 | A1 | 12/2005 | Shah | |
| 2006/0286841 | A1 | 12/2006 | Hale et al. | |
| 2007/0015391 | A1 | 1/2007 | Dowdle et al. | |
| 2007/0259549 | A1 | 11/2007 | Frye | |

* cited by examiner

*Primary Examiner* — John A Ward
(74) *Attorney, Agent, or Firm* — Roetzel & Andress

(57) ABSTRACT

Light fixtures adaptable for use with displays such as retail displays and using T-5 type lamps, the fixtures having a lamp housing, a mounting bracket, and lamp housing support arms which extend from the mounting bracket to the lamp housing, the lamp housing having a shroud and shroud end caps at each end of the shroud, the shroud end caps configured for interconnection with an opposing shroud end cap of another fixture whereby multiple fixtures can be interconnected in serial fashion.

18 Claims, 8 Drawing Sheets

DISPLAY LIGHT FIXTURES

RELATED APPLICATIONS

There are no applications related to this application.

FIELD OF THE INVENTION

The present disclosure and related inventions pertain generally to lighting and light fixtures, and more particularly to light fixtures which can be used for illumination of displays such as product displays, and which can be arranged in different configurations.

BACKGROUND OF THE INVENTION

Lighting fixtures for displays, such as retail store displays, have been made or adapted from existing commercial light fixtures. This can result in less than optimal lighting due to the many different types, sizes and configurations of retail displays. Lights have been incorporated into the construction and design of displays, although this requires significantly more engineering and cost, and limits the flexibility of the display for use with different types and quantities of products. Another problem with display lighting is distribution of electrical power to each display which is to be lit. In many stores, there may be few or only one power receptacle for a particular display or group of displays. There is therefore a requirement for a power bus, which adds to the complexity and cost of illuminated displays.

Installation and replacement of lamps is also a significant maintenance issue in retail operations. Many display fixtures are difficult to access and lamp replacement can be tedious. Because of the high cost of lamps, reduction of loss due to breakage from installation, replacement or other causes is important.

SUMMARY OF THE INVENTION

A display light fixture configured for use with T-5 type lamps and adaptable for use in connection with a display such as a retail display, the display light fixture having a lamp housing, a mounting bracket, and lamp housing support arms which extend from the mounting bracket to the lamp housing, the lamp housing having a shroud and shroud end caps at each end of the shroud, the shroud end caps configured for interconnection with an opposing shroud end cap of another fixture whereby multiple fixtures can be interconnected in serial fashion; T-5 lamp receptacles located within each of the shroud end caps, each T-5 lamp receptacle having first and second cooperating components which are interconnected and spring-biased for installation of a terminal end of a T-5 lamp and electrical contact with a power circuit of the fixture through electrical leads in the T-5 lamp receptacle. The lamp housing support arms are engaged with the mounting bracket by cooperating blocks which grip and engage ends of the support arms and through which electrical wiring extends to the T-5 lamp receptacles. The display light fixture can be attached to any suitable support structure, including attachment directly to a display, and can be combined with additional light fixtures by similar attachment of the mounting bracket and aligned interconnection of the shroud end caps.

DETAILED DESCRIPTION OF PREFERRED AND ALTERNATE EMBODIMENTS

As shown in FIGS. 1A-1F, a retail display light fixture, indicated generally at 100 includes a lamp housing 200, a mounting bracket 300, and lamp housing support arms 400. The retail display fixture 100 can be used in connection with any type of display in any type of store or for any other commercial or residential installation or use.

In general, the retail display fixture 100 is installed by attachment of the mounting bracket 300 to a supporting structure such as a frame F of a display (FIG. 1E), a wall, a display or any other type of structure with adequate strength. The mounting bracket 300 can be attached to a supporting structure in any particular orientation, as further described. The manner and orientation of attachment of the retail display fixture 100 to a support structure may be dictated in part by the configuration of the lamp housing support arms 400.

Although shown in one particular configuration, the lamp housing support arms 400 can be of any suitable or practical shape, configuration, length, size or number, and which accomplishes positioning of the lamp housing 200 at a location spaced from the mounting bracket 300. The lamp housing 200 and lamps therein are spaced or remote from the mounting bracket 300, which in connection with a display positions the light source in front of or remote from the display to achieve broad illumination of a display.

In the illustrated embodiment, the lamp housing 200 is generally configured to house a T-5 type lamp, which has a generally elongate and cylindrical shape, with electrical contacts at each end in the form of a metal cap through which extend two electrically conductive pins. In a typical prior art light fixture utilizing T-5 lamps, the lamp is installed in the fixture by engagement of the caps and pins with a fixed socket, one for each end of the lamp. Because the sockets are fixed and static, the lamp must be forcibly inserted into the sockets of the fixture in order to install and establish positive electrical contact.

Figure 1A:
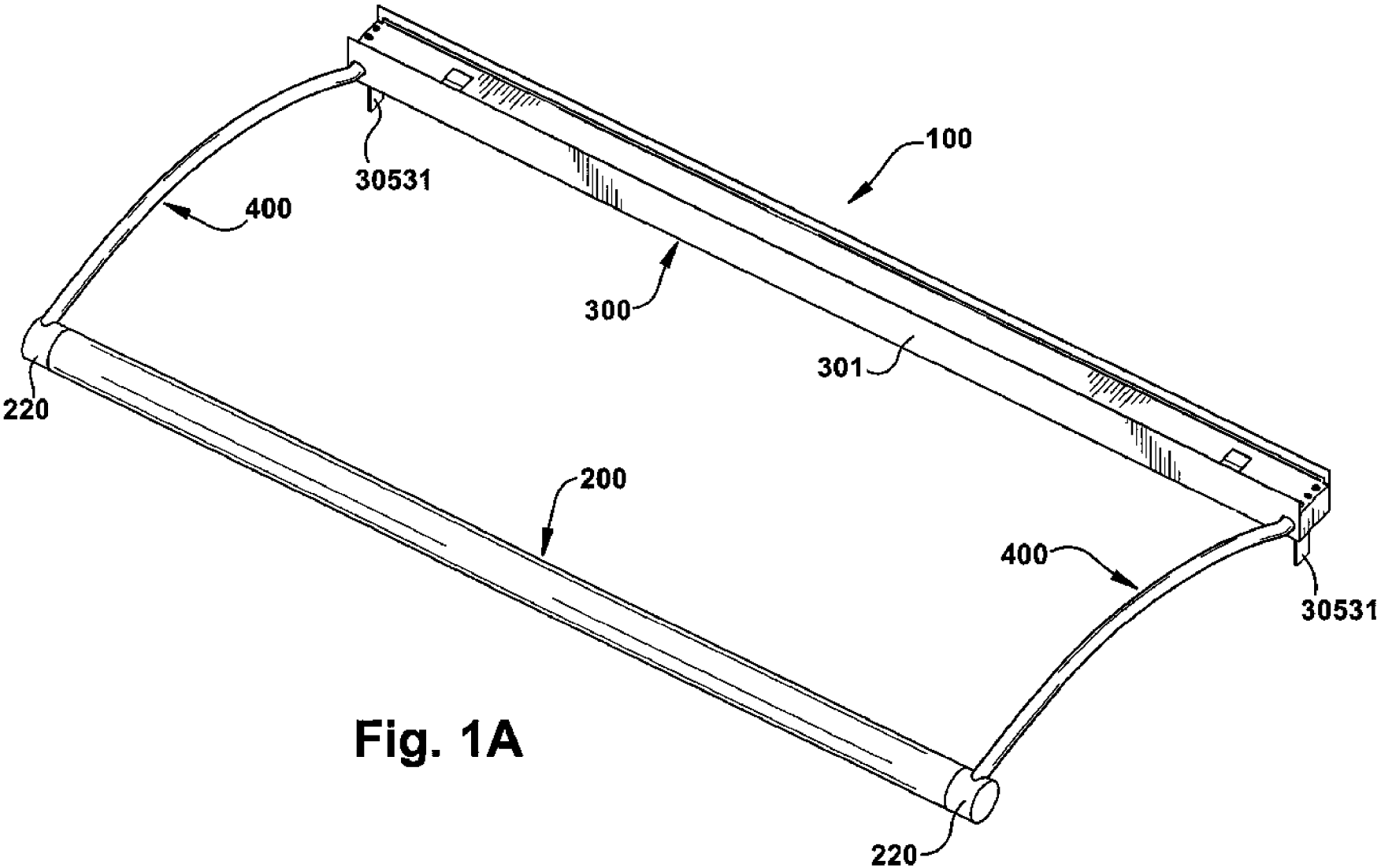
FIGS. 1A-1E illustrate a representative or exemplary embodiment of display light fixture of the disclosure and related inventions.
Figures 1B, 1C, 1D:
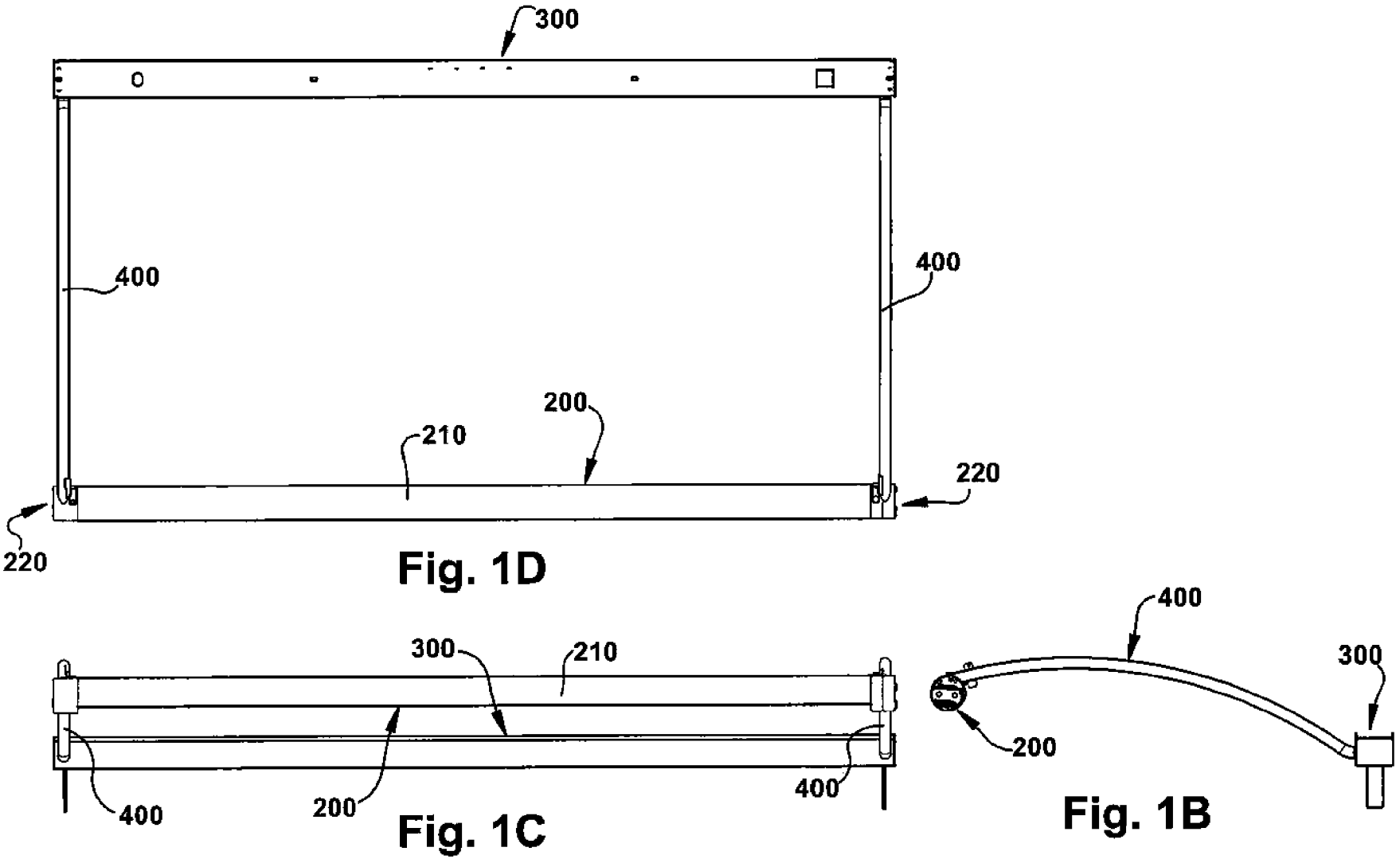
Figure 1E:
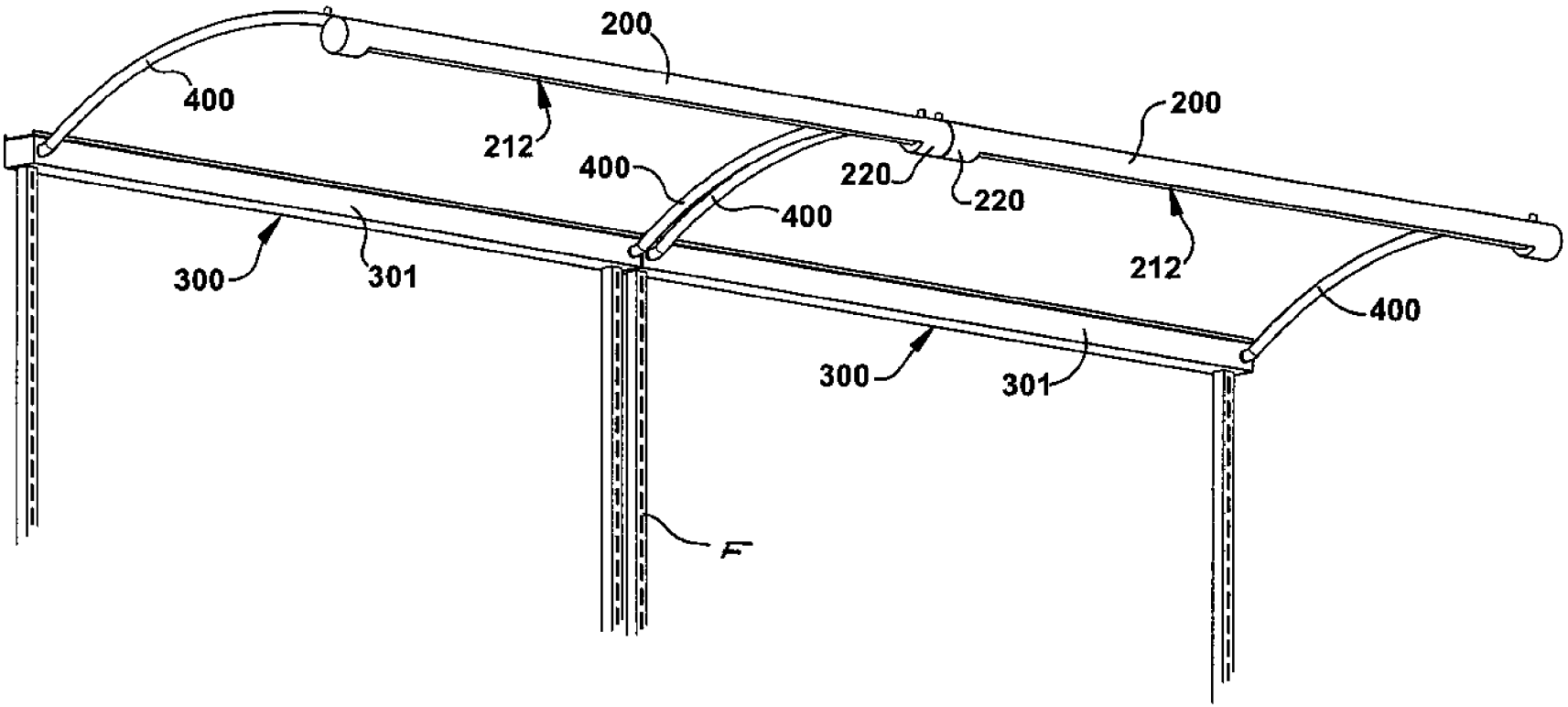
Figure 2A:
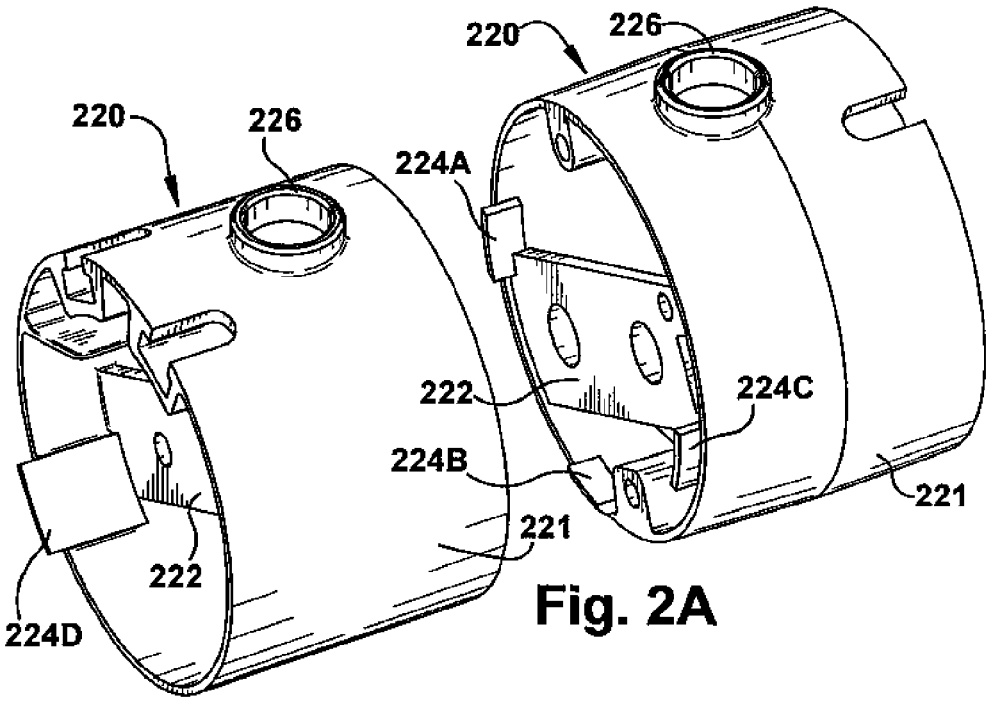
FIGS. 2A-2G illustrate a representative or exemplary embodiment of a fixture end connector of the disclosure and related inventions.
Figure 2B:
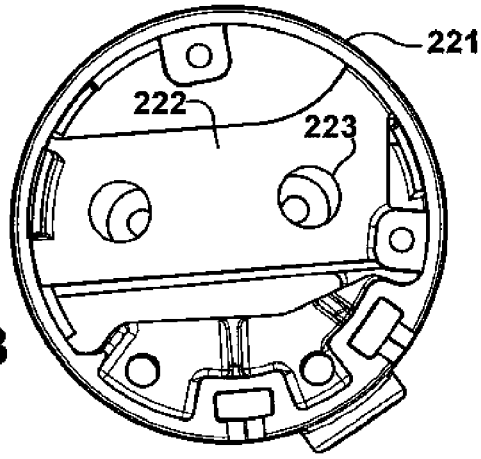
Figure 2C:
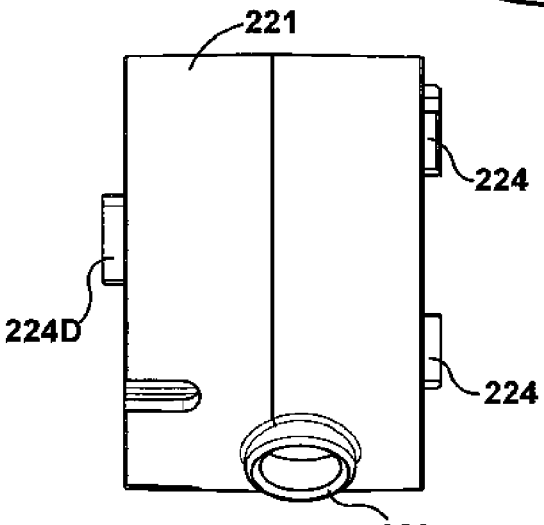
Figure 2D:
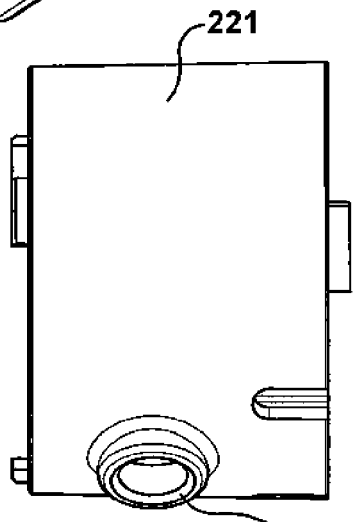
Figure 2E:
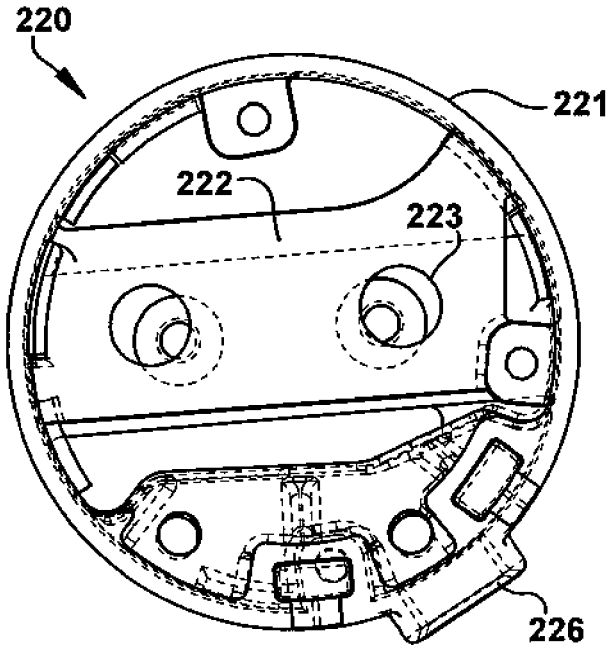
Figure 2F:
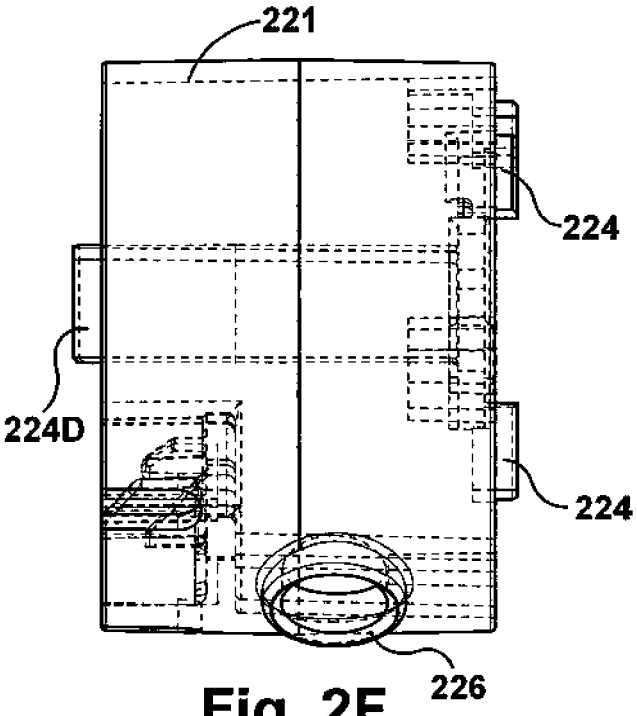
Figure 2G:
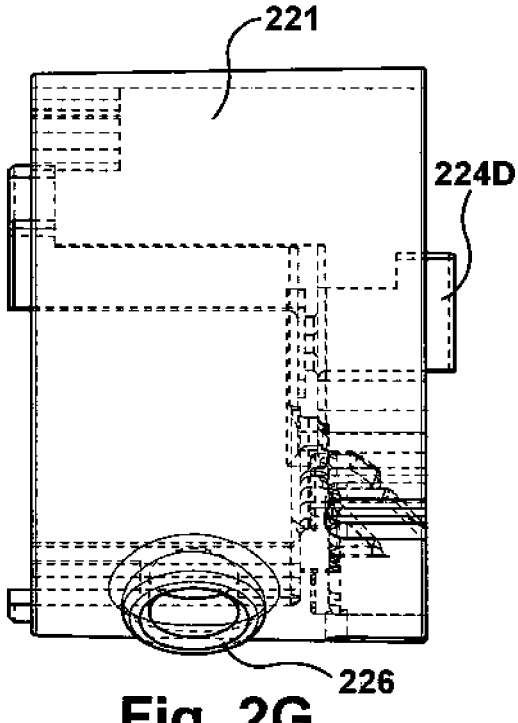
Figure 3A:
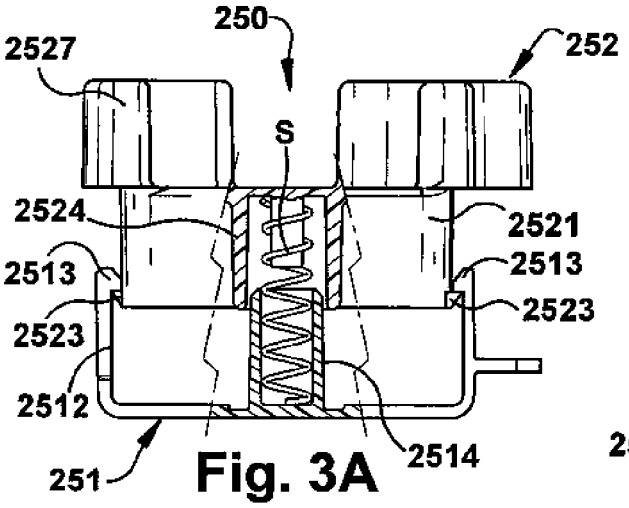
FIGS. 3A-3E illustrate a representative or exemplary embodiment of a spring-loaded lamp receptacle of the disclosure and related inventions.
Figure 3B:
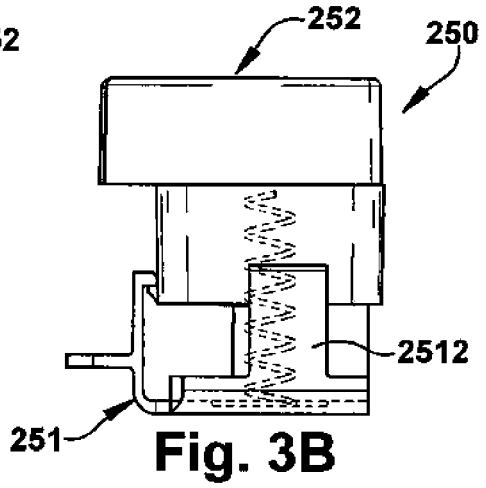
Figure 3C:
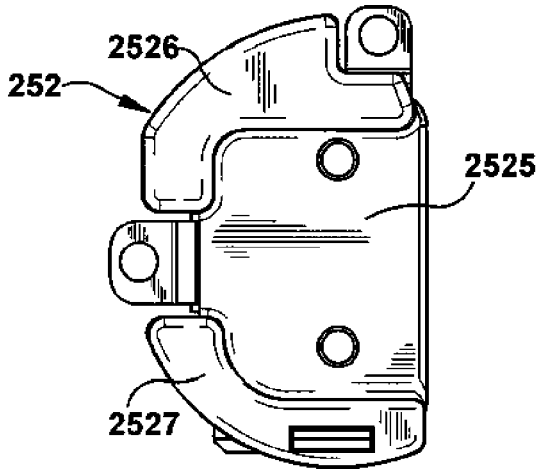
Figure 3D:
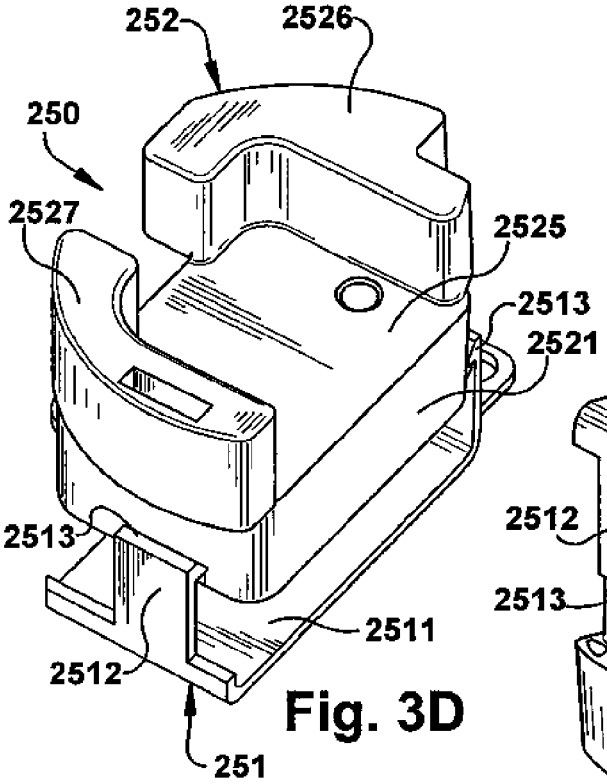
Figure 3E:
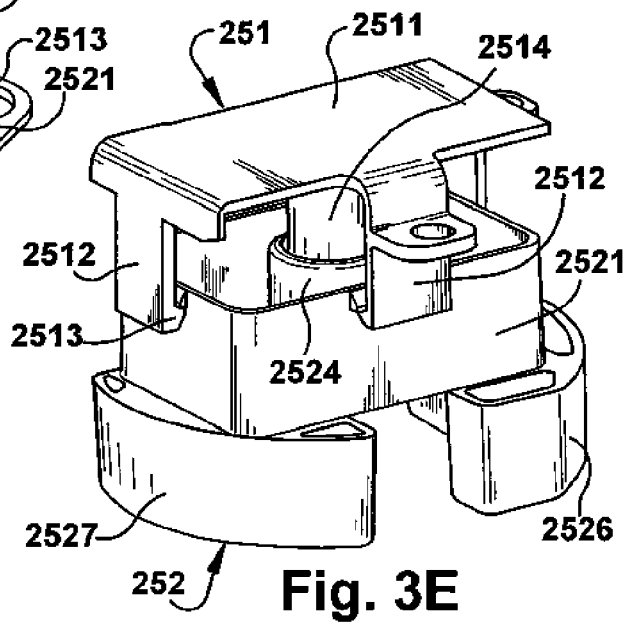

As shown in FIGS. 1A-1D and 2A-2D, the lamp housing 200 includes a generally elongate and cylindrical shroud 210 which generally or substantially surrounds the T-5 lamp, and which has an opening 212 which runs the substantial length of the shroud 210 to expose the lamp and direct the light therethrough. A shroud end cap 220 is fitted at each end of the shroud 210. Each shroud end cap 220 has a generally cylindrical body 221. Within the cylindrical body 221 are one or more internal braces 222 which extend transverse across a width of the cylindrical body 221. Axial passages 223 are formed through the internal braces 222 for serial wiring or other interconnection. Interconnection tabs 224 extend in an axial direction from both ends of the cylindrical body 221, in right and left versions (FIGS. 2D and 2C) with for example three tabs 224A, 224B, 224C from one end, and one tab 224D extending from the opposite end. The tabs 224A-224D are configured to fit within the outer cylindrical body 221 of an aligned and adjoining shroud end cap 220 in a flush serial fitting arrangement, as shown in FIG. 1E. In this manner, multiple display light fixtures can be serially joined to provide a continuous line of light source, as for example along the length of a display. Openings 226 are formed in the cylindrical body 221 of each shroud end cap 220 and dimensioned and configured to receive a distal end of a lamp housing support arm 400, as shown in FIG. 1D.

Within each of the shroud end caps 220 is located a T-5 lamp receptacle 250, as shown in FIGS. 3A-3E. T-5 type fluorescent lamps are produced in metric dimensions with nominal length of 549 mm, 849 mm and 1149 mm, and with two-pin conductive ends. As with T-8 type fluorescent lamps, the fixtures for T-5 type lamps are closely dimensioned to receive the length of the lamp, with the conductive ends engaged with a receptacle at each end, typically by rotation of the lamp which moves the conductive pins into electrical contact with the fixture ends. This mechanical style engagement can be awkward due to the requirement to rotate the lamp and engage both ends at the same time. To avoid this disadvantage, each of the T-5 lamp receptacles 250 are spring-biased to enable collapse to a smaller profile which increases the clearance room for insertion of a T-5 lamp of the proper size into the fixture. The T-5 lamp receptacle has a first component 251 which has a body wall 2511, extensions 2512 which extend from the body wall 2511, and locking tabs 2513 at distal ends of the extensions 2512, a spring boss 2514 ("first component spring boss") which also extends from the body wall 2511 and generally between the extensions 2512, the spring boss 2514 being configured to receive and align a spring S in an orientation generally perpendicular to and extending away from the body wall 2511 and parallel to the extensions 2512. Screw attachment flanges 2515 extend laterally from one or more of the extensions 2512 for attachment of the first component 251 to a supporting structure, such as a shroud end cap 220, by any suitable fastener.

Fitting and cooperating with the first component 251 is a second component 252 which has a perimeter wall 2521 which fits within the body wall 2511 and extensions 2512 of first component 251, and more particularly within the locking tabs 2513 of the first component 251, the second component 252 having corresponding locking tabs 2523 which are biased against locking tabs 2513 of the first component 251 by the spring S. The spring S extends into a spring boss 2524 ("second component spring boss") in the interior of the second component 252, i.e., within perimeter wall 2521. A main wall 2525 of the second component is oriented to face an interior of the fixture, opposed to a facing lamp receptacle 250. Extending generally axially from the main wall 2525 are first and second terminal guards 2526 and 2527. Between the terminal guards 2526, 2527 and the main wall 2525 is defined a space for receiving a terminal end of a T-5 type lamp. Terminal lead passages 2528 and 2529 are formed in the main wall 2525 for receiving electrical contact pins of the terminal end of the T-5 lamp. By the second component 252 being spring-biased and engaged to move relative to the first component 251, the terminal end of a T-5 lamp can be easily positioned for insertion between the terminal guards 2526, 2527, and the contact pins inserted through the terminal lead passages 2528, 2529.

As shown in FIGS. 4A-4E, and referring back to FIGS. 1A-1E, the mounting bracket 300 has a generally elongate body 301 which has a length dimension generally equivalent to a length dimension of the lamp housing 200. As noted the lamp housing support arms 400 extend generally laterally from the distal ends of the mounting bracket 300. To engage and support the support arms 400 with the mounting bracket 300, there are provided cooperating mounting blocks 302 and 303 which fit within the mounting bracket 300 proximate to the ends of the mounting bracket. Each mounting block 302, 303 has a respective body 3020 and 3030 with respective exterior sides 3024, 3034 and respective interior sides 3025, 3035. Half-tunnels 3021 and 3031 are formed respectively on interior sides 3025, 3035 to form together a cylindrical bore when the blocks are joined, each dimensioned to receive, grip and engage an end of a support arm 400. Alignment bullets 3032 are formed on the interior side 3035 of mounting block 303 and received in corresponding bullet holes 3022 formed in the interior side 3025 of mounting block 302. Also formed on the interior side 3035 of mounting block 303 is a stop boss 3036 which is generally aligned with the half tunnel 3031, and preferably located to generally bisect the half tunnel 3031 so that the mounting block assembly can be used in multiple orientations, and in double-sided installations wherein support arms extend from opposite sides of the mounting blocks and associated mounting bracket. The stop boss 3036 is designed to be contacted by an end of a mounting arm positioned in the half tunnels 3031, 3021 for secure engagement with the mounting blocks. Fastener bosses 3028 and 3038 are formed respectively in the bodies 3020, 3030 of the mounting blocks 302, 303 to fasten the blocks together securely about the end of a support arm positioned in the half tunnels.

Figure 4A:
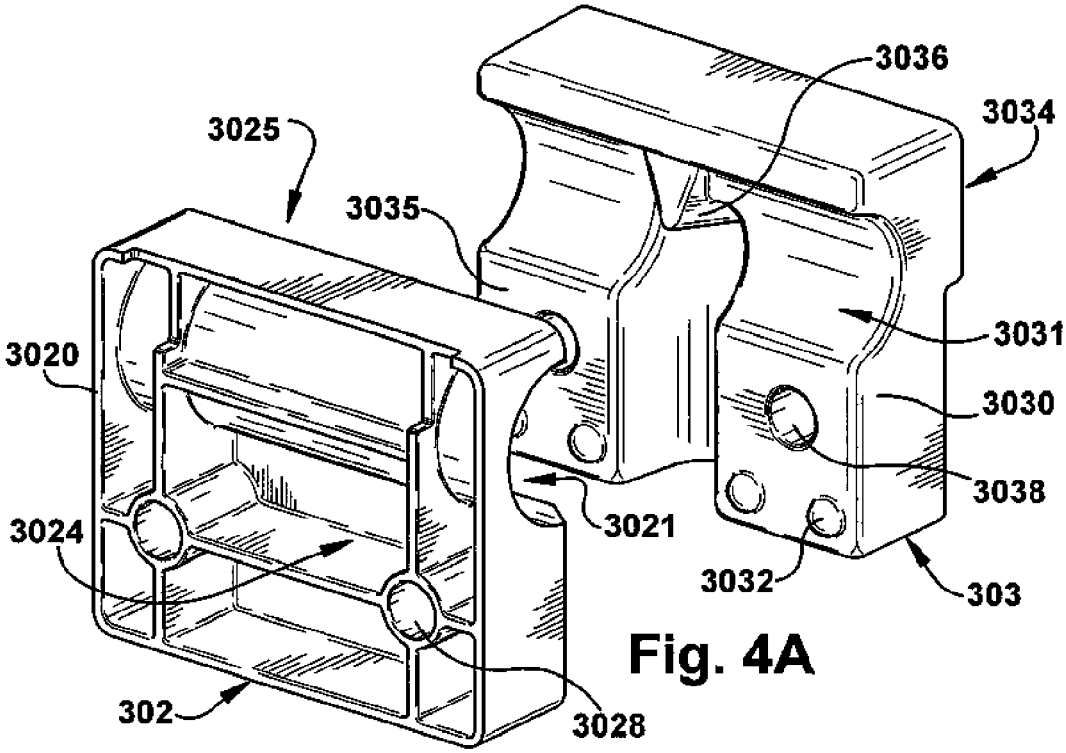
FIGS. 4A-4E illustrate a representative or exemplary embodiment of a block fitting component of a mounting system of the display light fixtures of the disclosure and related inventions.
Figure 4B:
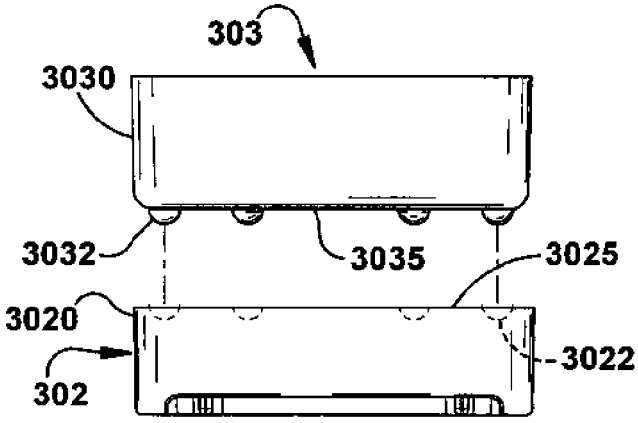
Figure 4C:
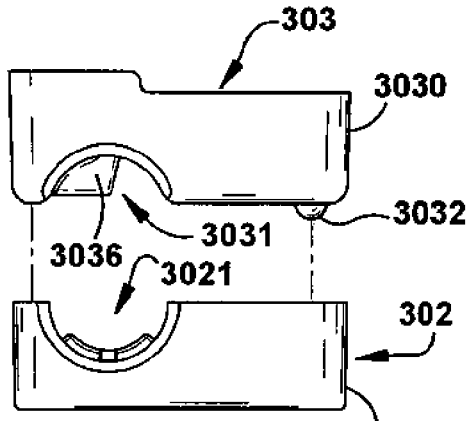
Figure 4D:
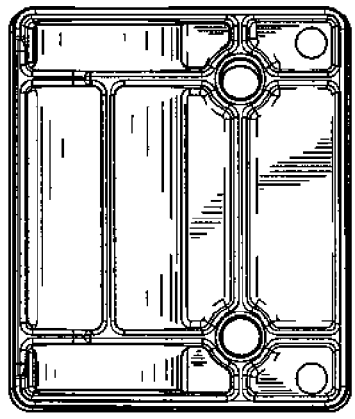
Figure 4E:
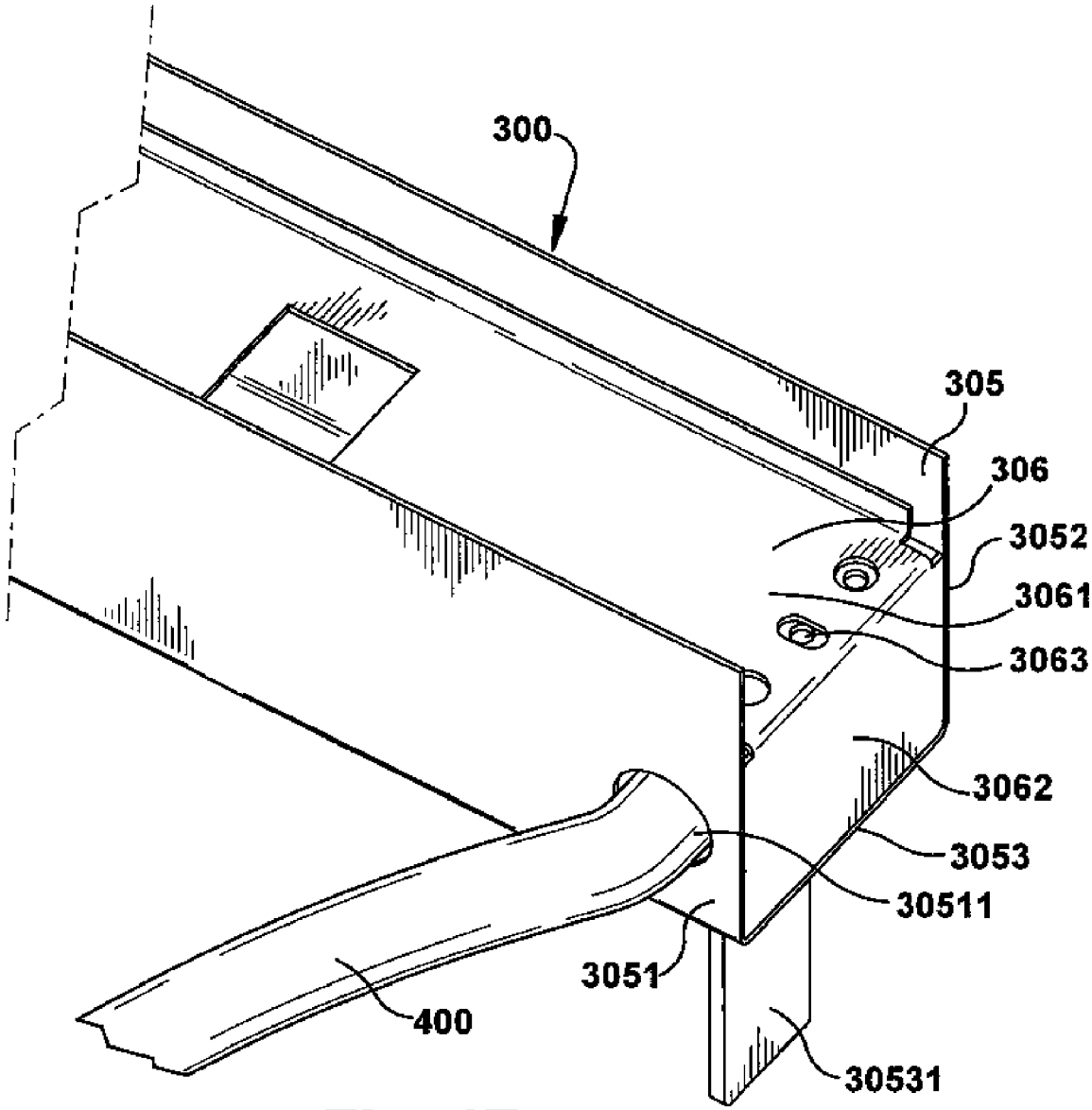

As shown in FIG. 4E, the mounting bracket 300 is formed by two cooperating channels 305 and 306. Channel 305 is in the general configuration of U-shaped channel, with parallel walls 3051 and 3052, and a connecting wall 3053. Channel 306 has a main wall 3061 which spans between the parallel walls 3051 and 3052, and an end wall 3062 which closes the end of channel 305. An opening 30511 is formed in side wall 3051 for passage of a support arm 400 into the interior of the channel and into the cylindrical bore of the mounting blocks 302, 303. Fastener openings 3063 are formed in wall 3061 of bracket 306 for attachment of channel 306 to mounting block 302 or 303.

The mounting bracket 300 is generally mounted to an overhead structure which is located above the area to be illuminated, such as a display, and can be supported in this position by any suitable framework, as shown for example in FIG. 1E. Mounting flanges 30531 extend from the channel 305 proximate the ends of the mounting bracket 300 for attachment to any supporting structure, such as the frame or superstructure of a display, or for any other installation. When so arranged, multiple mounting brackets 300 can be connected or aligned in series as shown for example in FIG. 1E. This positions the shroud end caps 220 in an aligned and abutting position, wherein the interconnection tabs 224 can be engaged with the opposing end cap to structurally connect multiple display light fixtures. Serial electrical wiring is run through the adjoining end caps 220.

The disclosure and related inventions thus provides an improved light fixture which can be advantageous used with displays to provide optimally positioned and sized illumination sourcing in a structurally sound yet unobtrusive fixture. Although illustrated and described with respect to particular and preferred embodiments, the various concepts and principals of the disclosure and related inventions can be equally applied to other embodiments and configurations which also incorporate the novel and nonobvious features and structures of the fixtures of the invention, as defined by the claims and equivalents thereto.

What is claimed as the invention is:

1. A display light fixture comprising:

a lamp housing, a mounting bracket, lamp housing support arms which extend between the mounting bracket and the lamp housing, the lamp housing and lamps therein spaced from the mounting bracket and configured for placement in connection with a display to position a light source generated by the lamps in front of or remote from a display to achieve broad illumination of a display;

the lamp housing configured and dimensioned to house at least one T-5 type lamp which has a generally elongate and cylindrical shape and electrical contacts at each end in the form of a metal cap through which extend two electrically conductive pins; the T-5 type lamp housing having a generally elongate and cylindrical shroud which substantially surrounds the T-5 type lamp, and an opening which runs a substantial length of the shroud and through which at least of portion of the lamp is exposed;

a shroud end cap fitted at each end of the lamp housing, each shroud end cap having a generally cylindrical body and one or more internal braces which extend transverse across a width of the cylindrical body; axial passages through the internal braces for serial wiring or other interconnection; interconnection tabs extending in an axial direction from both ends of the cylindrical body configured to fit within the cylindrical body of an aligned and adjoining shroud end cap of another display light fixture in a flush serial fitting arrangement; and an opening for receiving an end of one of the lamp housing support arms;

a T-5 type lamp receptacle located within each of the shroud end caps, each of the T-5 type lamp receptacles having first and second cooperating components which are spring-biased to enable collapse to a smaller profile which increases the clearance room for insertion of a T-5 type lamp into the fixture, the first component having a body wall, extensions which extend from the body wall, and locking tabs at distal ends of the extensions, a first component spring boss which also extends from the body wall and generally between the extensions, the spring boss receiving and aligning a spring in an orientation generally perpendicular to and extending away from the body wall and generally parallel to the extensions; a second component which fits with the first component and which has a main wall which is oriented parallel with the body wall of the first component and a perimeter wall which fits within the body wall of the first component and is engaged with the locking tabs of the first component, a second component spring boss which extends perpendicularly from the main wall and configured to receive an end of a spring in the second component spring boss, locking tabs which extend from the perimeter wall and which are biased against locking tabs of the first component by the spring, the spring extending into a spring boss in the interior of the second component; a main wall of the second component oriented to face an interior of the fixture, opposed to a facing lamp receptacle; first and second terminal guards extending generally axially from the main wall and spaced apart for receiving a terminal end of a T-5 type lamp, and terminal lead passages in the main wall for receiving electrical contact pins of the terminal end of the T-5 type lamp, the mounting bracket having a generally elongate body with a length dimension generally equivalent to a length dimension of the lamp housing, the lamp housing support arms extending generally laterally from ends of the mounting bracket;

first and second mounting blocks which fit together within the mounting bracket to engage and support the support arms, each mounting block having a body and a half-tunnel formed on an interior side of the body to form a cylindrical bore in which an end of a support arm is held;

the mounting bracket formed by first and second cooperating channels, the first channel in the general configuration of U-shaped channel, with parallel walls and a connecting wall, the second channel having a main wall which spans between the parallel walls and an end wall.

2. The display light fixture of claim 1 wherein the lamp housing has a length dimension which is approximately equal to a length dimension of the mounting bracket.

3. The display light fixture of claim 1 wherein the lamp housing support arms are generally arcuate between the mounting bracket and the lamp housing.

4. The display light fixture of claim 1 wherein the lamp housing support arms are oriented generally perpendicular to the mounting bracket.

5. The display light fixture of claim 1 wherein each shroud end cap is generally aligned with an end of the mounting bracket.

6. The display light fixture of claim 1 in combination with a display wherein the mounting bracket is secured to the display, and wherein the lamp housing is supported by the lamp housing support alms at an elevation above the mounting bracket.

7. The display light fixture of claim 1 in combination with an identically configured display light fixture and wherein the lamp housings of the display light fixtures are aligned and adjacent shroud end caps of the display light fixtures are engaged by the interconnection tabs.

8. The display light fixture of claim 1 wherein the first component further comprises at least one screw attachment flange which extends laterally from one of the extensions.

9. The display light fixture of claim 1 wherein the first component spring boss extends into the second component spring boss.

10. The display light fixture of claim 1 wherein the first and second terminal guards of the second component have an arcuate profile which fits within the generally cylindrical body of the shroud end caps.

11. The display light fixture of claim 1 wherein the mounting bracket is formed by first and second cooperating channels, the first channel being in the general configuration of U-shaped channel with two parallel side walls and a connecting wall, and a second channel which has a main wall which spans between the two parallel side walls of the first channel, and an end wall which closes the end of the first channel, an opening formed in the one of the side walls of the first channel for passage of a support arm into the interior of the mounting bracket and into the cylindrical bore of the mounting blocks.

12. The display light fixture of claim 1 wherein the mounting blocks are generally symmetrical and rectangular, and further comprising a stop boss which generally bisects one of the half tunnels of the mounting blocks.

13. The display light fixture of claim 1 wherein the mounting blocks are contained with the mounting bracket, and each of the cylindrical bores of the mounting blocks is aligned with an opening in the body of the mounting bracket.

14. The display light fixture of claim 1 wherein the mounting bracket further comprises a mounting flange proximate to each end of the mounting bracket and generally aligned with a support arm, the mounting flange configured for engagement with a support structure of a display.

15. A display light fixture in combination with a display having a structure for supporting products to be displayed and for supporting one or more display light fixtures at a location above the products on the display, the display light fixture comprising:

a lamp housing with one or more T-5 lamps located inside of the lamp housing, a mounting bracket, and lamp housing support arms which extend between the mounting bracket and the lamp housing, the lamp housing and T-5 lamps therein spaced from the mounting bracket and configured for placement in connection with a display to position a light source generated by the T-5 lamps in front of or remote from the display to achieve broad illumination of products on the display;

the lamp housing configured and dimensioned to house at least one T-5 type lamp which has a generally elongate and cylindrical shape and electrical contacts at each end in the form of a metal cap through which extend two electrically conductive pins; the lamp housing having a generally elongate and cylindrical shroud which substantially surrounds the T-5 type lamp, and an opening which runs a substantial length of the shroud and through which at least of portion of the lamp is exposed;

a shroud end cap fitted at each end of the lamp housing, each shroud end cap having a generally cylindrical body and one or more internal braces which extend transverse across a width of the cylindrical body; axial passages through the internal braces for serial wiring or other interconnection; interconnection tabs extending in an axial direction from both ends of the cylindrical body configured to fit within the cylindrical body of an aligned and adjoining shroud end cap of another display light fixture in a flush serial fitting arrangement; and an opening for receiving an end of one of the lamp housing support arms;

a T-5 type lamp receptacle located within each of the shroud end caps, each of the T-5 type lamp receptacles having first and second cooperating components which are spring-biased to enable collapse to a smaller profile which increases the clearance room for insertion of a T-5 type lamp into the fixture, the first component having a body wall, extensions which extend from the body wall, and locking tabs at distal ends of the extensions, a first component spring boss which also extends from the body wall and generally between the extensions, the spring boss receiving and aligning a spring in an orientation generally perpendicular to and extending away from the body wall and generally parallel to the extensions; a second component which fits with the first component and which has a main wall which is oriented parallel with the body wall of the first component and a perimeter wall which fits within the body wall of the first component and is engaged with the locking tabs of the first component, a second component spring boss which extends perpendicularly from the main wall and configured to receive an end of a spring in the second component spring boss, locking tabs which extend from the perimeter wall and which are biased against locking tabs of the first component by the spring, the spring extending into a spring boss in the interior of the second component; a main wall of the second component oriented to face an interior of the fixture, opposed to a facing lamp receptacle; first and second terminal guards extending generally axially from the main wall and spaced apart for receiving a terminal end of a T-5 type lamp, and terminal lead passages in the main wall for receiving electrical contact pins of the terminal end of the T-5 type lamp, the mounting bracket having a generally elongate body with a length dimension generally equivalent to a length dimension of the lamp housing, the lamp housing support arms extending generally laterally from ends of the mounting bracket;

first and second mounting blocks which fit together within the mounting bracket to engage and support the support arms, each mounting block having a body and a half-tunnel formed on an interior side of the body to form a cylindrical bore in which an end of a support arm is held;

the mounting bracket formed by first and second cooperating channels, the first channel in the general configuration of U-shaped channel, with parallel walls and a connecting wall, the second channel having a main wall which spans between the parallel walls and an end wall.

16. A display light fixture with T-5 type lamps for illumination of a retail display, the display light fixture comprising:

a lamp housing, a mounting bracket, and lamp housing support arms which extend between the mounting bracket and the lamp housing, the lamp housing and lamps therein spaced from the mounting bracket and configured for placement in connection with a display to position a light source generated by the lamps in front of or remote from a display to achieve broad illumination of a display;

the lamp housing configured and dimensioned to house at least one T-5 type lamp which has a generally elongate and cylindrical shape and electrical contacts at each end in the form of a metal cap through which extend two electrically conductive pins; the T-5 type lamp housing having a generally elongate and cylindrical shroud which substantially surrounds the T-5 type lamp, and an opening which runs a substantial length of the shroud and through which at least of portion of the lamp is exposed;

a shroud end cap fitted at each end of the lamp housing, each shroud end cap having a generally cylindrical body and one or more internal braces which extend transverse across a width of the cylindrical body; axial passages through the internal braces for serial wiring or other interconnection; interconnection tabs extending in an axial direction from both ends of the cylindrical body configured to fit within the cylindrical body of an aligned and adjoining shroud end cap of another display light fixture in a flush serial fitting arrangement; and an opening for receiving an end of one of the lamp housing support arms.

17. The display light fixture of claim 16 wherein a T-5 type lamp receptacle is located within each of the shroud end caps, each of the T-5 type lamp receptacles having first and second cooperating components which are spring-biased to enable collapse to a smaller profile which increases the clearance room for insertion of a T-5 type lamp into the fixture, the first component having a body wall, extensions which extend from the body wall, and locking tabs at distal ends of the extensions, a first component spring boss which also extends from the body wall and generally between the extensions, the spring boss receiving and aligning a spring in an orientation generally perpendicular to and extending away from the body wall and generally parallel to the extensions; a second component which fits with the first component and which has a main wall which is oriented parallel with the body wall of the first component and a perimeter wall which fits within the body wall of the first component and is engaged with the locking tabs of the first component, a second component spring boss which extends perpendicularly from the main wall and configured to receive an end of a spring in the second component spring boss, locking tabs which extend from the perimeter wall and which are biased against locking tabs of the first component by the spring, the spring extending into a spring boss in the interior of the second component; a main wall of the second component oriented to face an interior of the fixture, opposed to a facing lamp receptacle; first and second terminal guards extending generally axially from the main wall and spaced apart for receiving a terminal end of a T-5 type lamp, and terminal lead passages in the main wall for receiving electrical contact pins of the terminal end of the T-5 type lamp.

18. The display light fixture of claim 16 wherein the mounting bracket has a generally elongate body with a length dimension generally equivalent to a length dimension of the lamp housing, the lamp housing support arms extending generally laterally from ends of the mounting bracket; first and second mounting blocks which fit together within the mounting bracket to engage and support the support arms, each mounting block having a body and a half-tunnel formed on an interior side of the body to form a cylindrical bore in which an end of a support arm is held; the mounting bracket formed by first and second cooperating channels, the first channel in the general configuration of U-shaped channel, with parallel walls and a connecting wall, the second channel having a main wall which spans between the parallel walls and an end wall.

* * * * *